US011235583B2

(12) United States Patent
Anno et al.

(10) Patent No.: US 11,235,583 B2
(45) Date of Patent: Feb. 1, 2022

(54) INKJET PRINTING DEVICE AND INK REMAINING QUANTITY DETECTION METHOD IN INKJET PRINTING DEVICE

(71) Applicant: SCREEN HOLDINGS CO., LTD., Kyoto (JP)

(72) Inventors: Motoyuki Anno, Kyoto (JP); Mitsuru Tanemoto, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 16/975,246

(22) PCT Filed: Feb. 13, 2019

(86) PCT No.: PCT/JP2019/005113

§ 371 (c)(1),
(2) Date: Aug. 24, 2020

(87) PCT Pub. No.: WO2019/167624

PCT Pub. Date: Sep. 6, 2019

(65) Prior Publication Data

US 2020/0398580 A1 Dec. 24, 2020

(30) Foreign Application Priority Data

Feb. 28, 2018 (JP) ..... JP2018-035741

(51) Int. Cl.
*B41J 2/175* (2006.01)

(52) U.S. Cl.
CPC ..... *B41J 2/17566* (2013.01); *B41J 2/17596* (2013.01)

(58) Field of Classification Search
CPC .... B41J 2/17566; B41J 2/17596; B41J 2/175; B41J 2002/17569
(Continued)

(56) References Cited

U.S. PATENT DOCUMENTS 9,028,021 B2 * 5/2015 Uetsuki ..... B41J 2/17566 347/7
10,259,246 B2 * 4/2019 Sawase ..... B41J 2/18
(Continued)

FOREIGN PATENT DOCUMENTS

JP 2007-105994 A 4/2007
JP 2008-296535 A 12/2008
(Continued)

OTHER PUBLICATIONS

International Search Report issued in corresponding International Patent Application No. PCT/JP2019/005113, dated May 7, 2019, with English translation.
(Continued)

*Primary Examiner* — An H Do
(74) *Attorney, Agent, or Firm* — McDermott Will & Emery LLP

(57) ABSTRACT

An inkjet printing apparatus includes a first and second tanks, and a printer section including an inkjet head which ejects ink droplets toward a printing medium. The inkjet printing apparatus includes a first supply system which supplies ink from the first tank to the second tank, a second supply system which includes an ink supply pump and supplies ink from the second tank to the printer section, and a remaining amount detection unit which detects the amount of ink remaining in the first tank. The remaining amount detection unit calculates the amount of ink transferred from the first tank to the second tank in a measurement period during which ink is supplied from the first tank to the second tank, based on an increase in the amount of the ink stored in the second tank in the measurement period and the operation state of the pump in the measurement period.

8 Claims, 9 Drawing Sheets

(58) Field of Classification Search
USPC ..... 347/7, 84, 85
See application file for complete search history.

(56) References Cited

U.S. PATENT DOCUMENTS

| | | | |
|---|---|---|---|
| 2007/0145636 | A1 | 6/2007 | Johns et al. |
| 2016/0347071 | A1 | 12/2016 | Saeki et al. |

FOREIGN PATENT DOCUMENTS

| | | | |
|---|---|---|---|
| JP | 2011-164375 | A | 8/2011 |
| JP | 2015-066804 | A | 4/2015 |
| JP | 2016-107567 | A | 6/2016 |
| JP | 2016-221848 | A | 12/2016 |

OTHER PUBLICATIONS

Translation of Notification of Transmittal of International Preliminary Report on Patentability and Translation of the International Preliminary Report on Patentability for PCT/JP2019/005113, dated Sep. 10, 2020.

* cited by examiner

INKJET PRINTING DEVICE AND INK REMAINING QUANTITY DETECTION METHOD IN INKJET PRINTING DEVICE

CROSS REFERENCE TO RELATED APPLICATIONS

This application is the U.S. National Phase under 35 U.S.C. § 371 of International Application No. PCT/JP2019/005113, filed on Feb. 13, 2019, which claims the benefit of Japanese Application No. 2018-035741, filed on Feb. 28, 2018, the entire contents of each are hereby incorporated by reference.

TECHNICAL FIELD

This application claims the priority benefit of Japanese Patent Application No. 2018-35741 filed on Feb. 28, 2018, the disclosure of which is entirely incorporated herein.

The present invention relates to an inkjet printing apparatus which performs a printing operation on a printing medium by ejecting ink droplets from an inkjet head, and a method for detecting a remaining ink amount in the inkjet printing apparatus.

BACKGROUND ART

Inkjet printing machines, particularly large-scale inkjet printing machines, include a conveyance portion which conveys a printing medium such as paper, a printer portion which ejects ink droplets toward the printing medium conveyed by the conveyance portion, and an ink supply portion which supplies ink to the printer portion. The ink supply portion includes an ink tank which stores the ink, and an ink supply system which feeds the ink from the ink tank toward the printer portion (e.g., PTL 1).

CITATION LIST

Patent Literature

PTL1: JP2008-296535A

SUMMARY OF INVENTION

Problem to be Solved by Invention

When the amount of ink remaining in the ink tank is reduced to zero during the printing operation, the printing operation is interrupted. Therefore, the size of the ink tank is increased so as to reduce the frequency of ink replenishment. Where the ink tank has a larger size, however, it is impossible to detect the remaining ink amount with high accuracy.

It is an object of the present invention to provide an inkjet printing apparatus which is capable of accurately detecting the amount of ink remaining in an ink tank thereof even if the ink tank has a larger size, and to provide a method for detecting the remaining ink amount.

Solution to Problem

According to one embodiment of the present invention, there is provided an inkjet printing apparatus which includes: a first tank which stores ink; a second tank which stores ink; and a printer section including an inkjet head which ejects ink droplets toward a printing medium. The inkjet printing apparatus includes: a first supply system which supplies ink from the first tank to the second tank; a second supply system which includes an ink supply pump and supplies ink from the second tank to the printer section; and a remaining amount detection unit which detects the amount of ink remaining in the first tank. The remaining amount detection unit calculates the amount of ink transferred from the first tank to the second tank in a measurement period during which ink is supplied from the first tank to the second tank, based on an increase in the amount of the ink stored in the second tank in the measurement period and the operation state of the pump in the measurement period. The remaining amount detection unit detects the amount of ink remaining in the first tank at the end of the measurement period by subtracting the transferred ink amount from the amount of ink remaining in the first tank at the start of the measurement period.

With this arrangement, the amount of the ink remaining in the first tank can be easily and accurately detected.

In an embodiment of the present invention, a first liquid surface level and a second liquid surface level lower than the first liquid surface level are defined in the second tank. The second tank includes a first liquid surface sensor which detects an ink liquid surface at the first liquid surface level, and a second liquid surface sensor which detects the ink liquid surface at the second liquid surface level. The remaining amount detection unit defines the measurement period as a period between the start of elevation of the ink liquid surface from the second liquid surface level and the detection of the ink liquid surface at the first liquid surface level by the first liquid surface sensor.

With this arrangement, the start and the end of the measurement period can be easily determined based on the ink liquid surface levels detected by the first liquid surface sensor and the second liquid surface sensor.

In an embodiment of the present invention, the pump is a metering pump which supplies a predetermined amount of ink per unit drive amount. The remaining amount detection unit determines the operation state of the pump by determining a total unit drive amount of the pump for which the pump is driven in the measurement period.

With this arrangement, the operation state of the pump can be determined with higher reproducibility.

In an embodiment of the present invention, a calibration operation is performed to operate the pump until the ink liquid surface is lowered to the second liquid surface level in the second tank in a state such that the ink supply to the second tank by the first supply system is stopped and the ink is stored to the first liquid surface level in the second tank. The amount of ink stored in a space of the second tank between the first liquid surface level and the second liquid surface level is defined as a measurement liquid amount. The remaining amount detection unit calculates an ink supply amount per unit drive amount of the pump by dividing the measurement liquid amount by a total unit drive amount of the pump for which the pump is driven during the calibration operation.

With this arrangement, the ink supply amount per unit drive amount of the pump is accurately determined by the calibration operation. Therefore, the remaining ink amount of the first tank can be detected with higher accuracy.

In an embodiment of the present invention, the pump is a metering pump which supplies a predetermined amount of ink per unit time. The remaining amount detection unit determines the operation state of the pump by determining a total drive time during which the pump is driven in the measurement period.

With this arrangement, the operation state of the pump can be determined simply by determining the total drive time. Therefore, the remaining ink amount of the first tank can be more easily detected.

According to another embodiment of the present invention, there is provided a method for detecting a remaining ink amount in an inkjet printing apparatus. The inkjet printing apparatus includes: a first tank which stores ink; a second tank which stores ink; a printer section including an inkjet head which ejects ink droplets toward a printing medium; a first supply system which supplies ink from the first tank to the second tank; and a second supply system which includes an ink supply pump and supplies ink from the second tank to the printer section. The ink remaining amount detection method includes a transferred ink amount calculation step of calculating the amount of ink transferred from the first tank to the second tank in a measurement period during which ink is supplied from the first tank to the second tank, based on an increase in the amount of the ink stored in the second tank in the measurement period and the operation state of the pump in the measurement period. The method further includes a remaining amount detection step of detecting the amount of ink remaining in the first tank at the end of the measurement period by subtracting the transferred ink amount from the amount of ink remaining in the first tank at the start of the measurement period.

This method makes it possible to easily and accurately detect the remaining ink amount of the first tank.

The foregoing and other objects, features, and effects of the present invention will become more apparent from the following description of embodiments with reference to the attached drawings.

DESCRIPTION OF EMBODIMENTS

Figure 1:
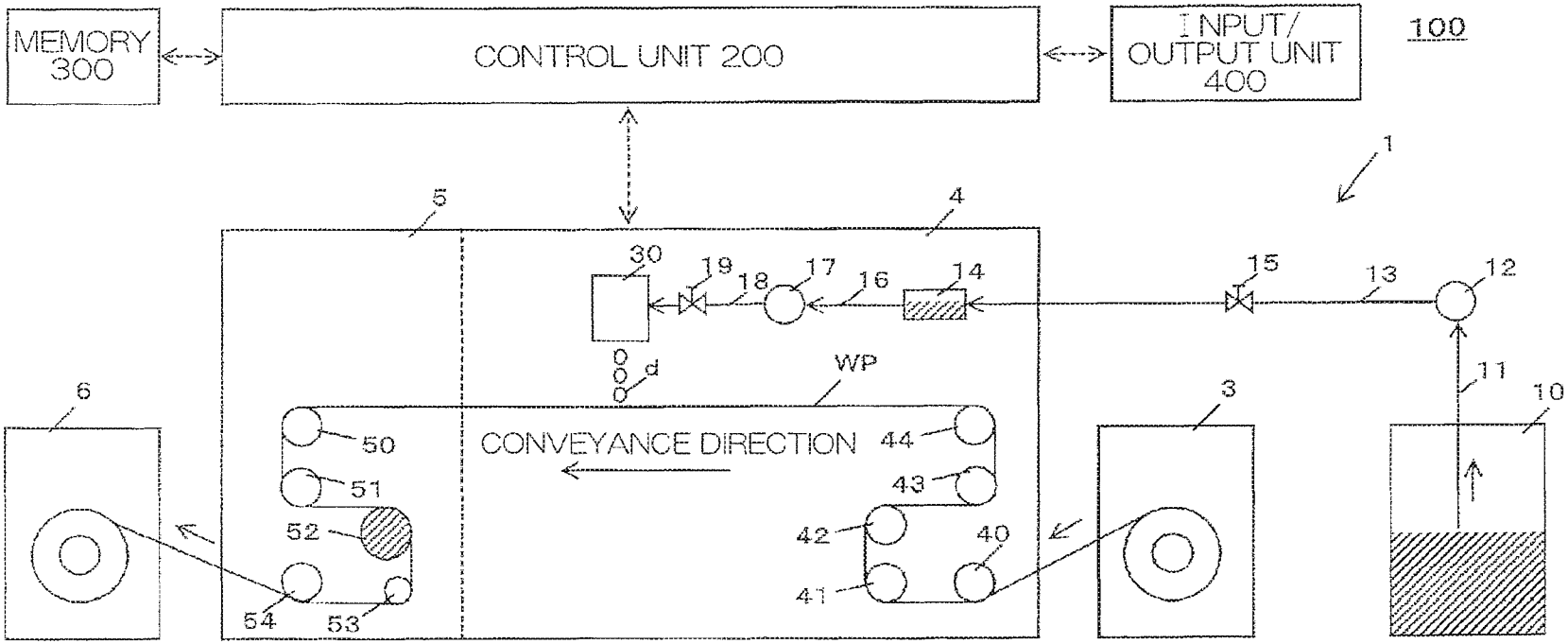
FIG. 1 is a schematic construction diagram of an inkjet printing apparatus according to one embodiment.

FIG. 1 is a schematic construction diagram of an inkjet printing apparatus according to one embodiment of the present invention.

The inkjet printing apparatus 100 (hereinafter referred to as "printing apparatus 100") performs a printing operation on long continuous paper WP (printing medium). The printing apparatus 100 includes an ink supply section 1, a paper feeding section 3, a printing unit 4, a drying unit 5, and a paper output section 6. The paper feeding section 3 rotatably holds a roll of the continuous paper WP, and feeds the continuous paper WP. The continuous paper WP is conveyed through the printing unit 4, the drying unit 5, and the paper output section 6 in this order in the printing apparatus 100. The printing unit 4 performs the printing operation on the continuous paper WP. The drying unit 5 dries the continuous paper WP.

The printing unit 4 includes a drive roller 40, timing rollers 41 to 43, a drive roller 44, and a printer section 30, which are disposed in this order from the upstream side to the downstream side with respect to the continuous paper WP. The drive roller 40 is driven to be rotated by a motor not shown to draw the continuous paper WP from the paper feeding section 3. The drive roller 44 is driven to be rotated by a motor not shown to feed the continuous paper WP to the printer section 30. The timing rollers 41 to 43 are each a driven roller. That is, the timing rollers 41 to 43 are rotatably provided, and are rotated by the conveyance of the continuous paper WP. The printer section 30 is of an inkjet type adapted to eject ink droplets d based on image data.

The drying unit 5 includes a drive roller 50, a timing roller 51, a heat roller 52, a timing roller 53, and a drive roller 54, which are disposed in this order from the upstream side to the downstream side with respect to the continuous paper WP. The drive roller 50 is driven to be rotated by a motor not shown to convey the continuous paper WP printed by the printer section 30 to the downstream side. The heat roller 52 includes a heat source not shown to heat and dry the continuous paper WP printed by the printer section 30. The drive roller 54 is driven to be rotated by a motor not shown to convey the continuous paper WP toward the paper output section 6. The timing rollers 51 and 53 are each a driven roller. That is, the timing rollers 51 and 53 are rotatably provided, and are rotated by the conveyance of the continuous paper WP. The paper output section 6 winds the continuous paper outputted from the drying unit 5 into a roll, and recovers the roll.

The ink supply section 1 includes a main tank 10, a first pipe 11, a first pump 12, a second pipe 13, a buffer tank 14, a first valve 15, a third pipe 16, a second pump 17, a fourth pipe 18, and a second valve 19.

The main tank 10 is an ink tank capable of storing a greater amount (e.g., 200 liters) of ink. In the following description, the amount of ink stored in the main tank 10 when the printer section 30 starts the printing operation is sometimes referred to as "initial ink amount v1." The first pump 12 pumps out ink from the main tank 10 through the first pipe 11 and supplies the ink to the buffer tank 14 through the second pipe 13. The first valve 15, which is provided in the second pipe 13, closes (fully closes) and opens (fully opens) the second pipe 13, whereby the flow rate of the ink flowing through the second pipe 13 is changed between zero and a full open flow rate.

The buffer tank 14 is a tank which temporarily stores ink to be fed from the main tank 10 to the printer section 30, and temporarily stores a smaller amount (e.g., 10 liters) of ink than the main tank 10. The second pump 17 pumps out ink from the buffer tank 14 through the third pipe 16 and supplies the ink to the printer section 30 through the fourth pipe 18. The second pump 17 is a metering pump designed to pump out a predetermined unit amount of ink per unit time. The second pump 17 is controlled by a control unit 200, and continues to pump out the ink during a period in which a drive signal applied from the control unit 200 is ON.

The second valve 19, which is provided in the fourth pipe 18, closes (fully closes) and opens (fully opens) the fourth pipe 18, whereby the flow rate of the ink flowing through the fourth pipe 18 is changed between zero and a full open flow rate.

The main tank 10 corresponds to an example of the first tank in the embodiment of the present invention, and the buffer tank 14 corresponds to an example of the second tank in the embodiment of the present invention. The first pipe 11, the first pump 12, the second pipe 13, and the first valve 15 constitute an example of the first supply system in the embodiment of the present invention. The third pipe 16, the second pump 17, the fourth pipe 18, and the second valve 19 constitute an example of the second supply system in the embodiment of the present invention.

In this embodiment, the single main tank 10 supplies ink only to the single printing apparatus 100. However, the single main tank 10 may supply ink to a plurality of printing apparatuses 100. In this case, the single first pump 12 provided for the main tank 10 may pump out the ink from the main tank 10, and distributively supply the pumped ink to the second pipes 13 of the respective printing apparatuses 100.

The components of the printing apparatus 100, i.e., the first pump 12, the first valve 15, the second pump 17, the second valve 19, the printer section 30, the drive rollers 40, 44, 50 and 54, and the like, are comprehensively controlled by the control unit 200. The control unit 200 includes a CPU (central processing unit), a memory, and the like, and receives image data externally applied through an input/output unit 400 for the printing operation on the continuous paper WP.

Figure 2:
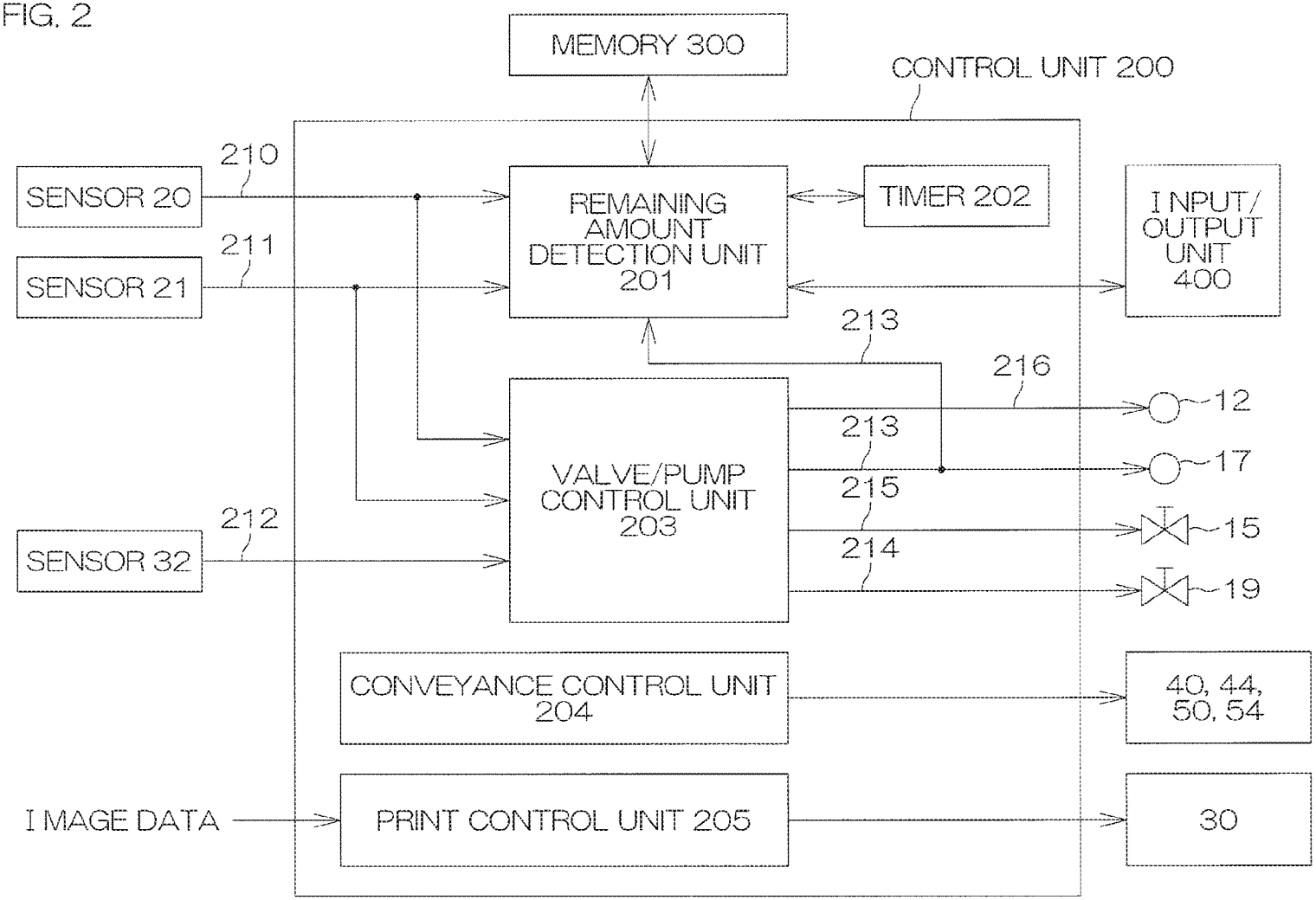
FIG. 2 is a block diagram schematically showing the functional configuration of a control unit 200.

FIG. 2 is a block diagram schematically showing the functional configuration of the control unit 200. From a functional viewpoint, the control unit 200 includes a remaining amount detection unit 201, a timer 202, a valve/pump control unit 203, a conveyance control unit 204, and a print control unit 205. The CPU of the control unit 200 executes a control program preliminarily stored in a ROM or the like, thereby functioning as the remaining amount detection unit 201, the timer 202, the valve/pump control unit 203, the conveyance control unit 204, the print control unit 205, and other functional portions.

The remaining amount detection unit 201 detects the amount of ink remaining in the main tank 10 by executing a remaining amount detection flow sequence to be described later. The timer 202 counts the drive time of the second pump 17 in a measurement period to be described later, and sends the counted drive time to the remaining amount detection unit 201. The valve/pump control unit 203 receives signals outputted from a first liquid surface sensor 20, a second liquid surface sensor 21, and a sub-tank sensor 32 (to be described later) to control the first pump 12, the second pump 17, the first valve 15, and the second valve 19.

The memory 300 and the input/output unit 400 are connected to the remaining amount detection unit 201 of the control unit 200. The memory 300 stores the initial ink amount v1 described above, and further stores a measurement liquid amount v2, a unit liquid pumping amount v3, a transferred ink amount v4, and a remaining ink amount v5 to be described later, which are sent to the remaining amount detection unit 201 at proper timing. The input/output unit 400 receives a start command and an end command of the printing operation from a user, and sends these commands to the remaining amount detection unit 201, the valve/pump control unit 203, the conveyance control unit 204, and the print control unit 205. The input/output unit 400 further receives data of an image to be printed by the printing apparatus 100 and an estimated ink amount necessary for the printing of the image data from a host apparatus such as an image editing apparatus. The estimated ink amount necessary for the printing of the image data may be calculated based on the image data of interest by the print control unit 205. The remaining amount detection unit 201 sequentially detects the remaining ink amount of the main tank 10 by executing the remaining amount detection flow sequence to be described later. That is, the remaining amount detection unit 201 corresponds to an example of the remaining amount detection unit in the embodiment of the present invention. The remaining amount detection unit 201 can report the detected remaining ink amount to the user through the input/output unit 400.

Figure 3:
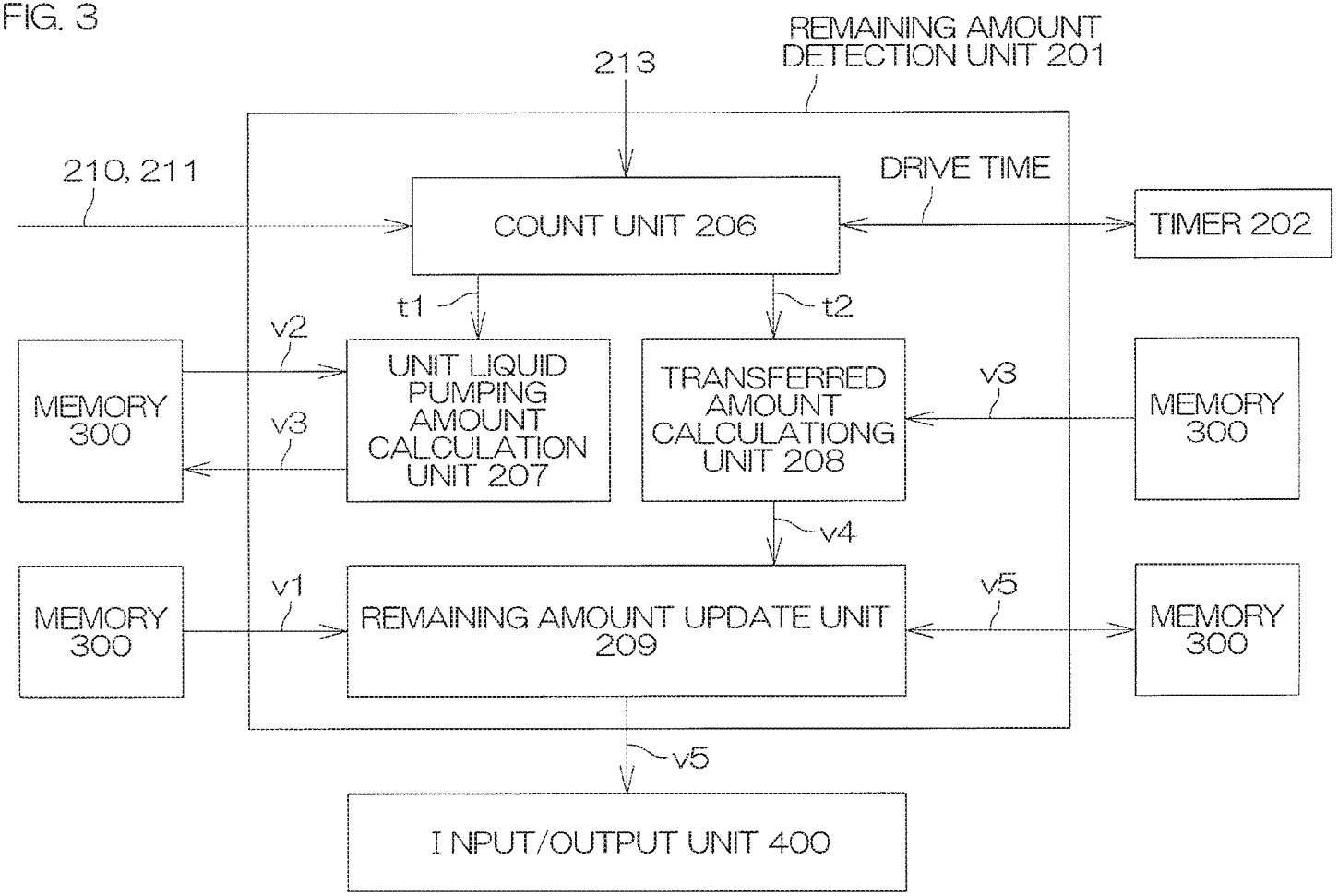
FIG. 3 is a block diagram schematically showing the functional configuration of a remaining amount detection unit 201.

FIG. 3 is a block diagram showing the detailed functional configuration of the remaining amount detection unit 201 by way of example. As shown in FIG. 3, the remaining amount detection unit 201 includes a count unit 206, a unit liquid pumping amount calculation unit 207, a transferred amount calculation unit 208, and a remaining amount update unit 209. The configurations of the respective components of the remaining amount detection unit 201 will be described with reference to the remaining amount detection flow sequence to be described later.

Figure 4:
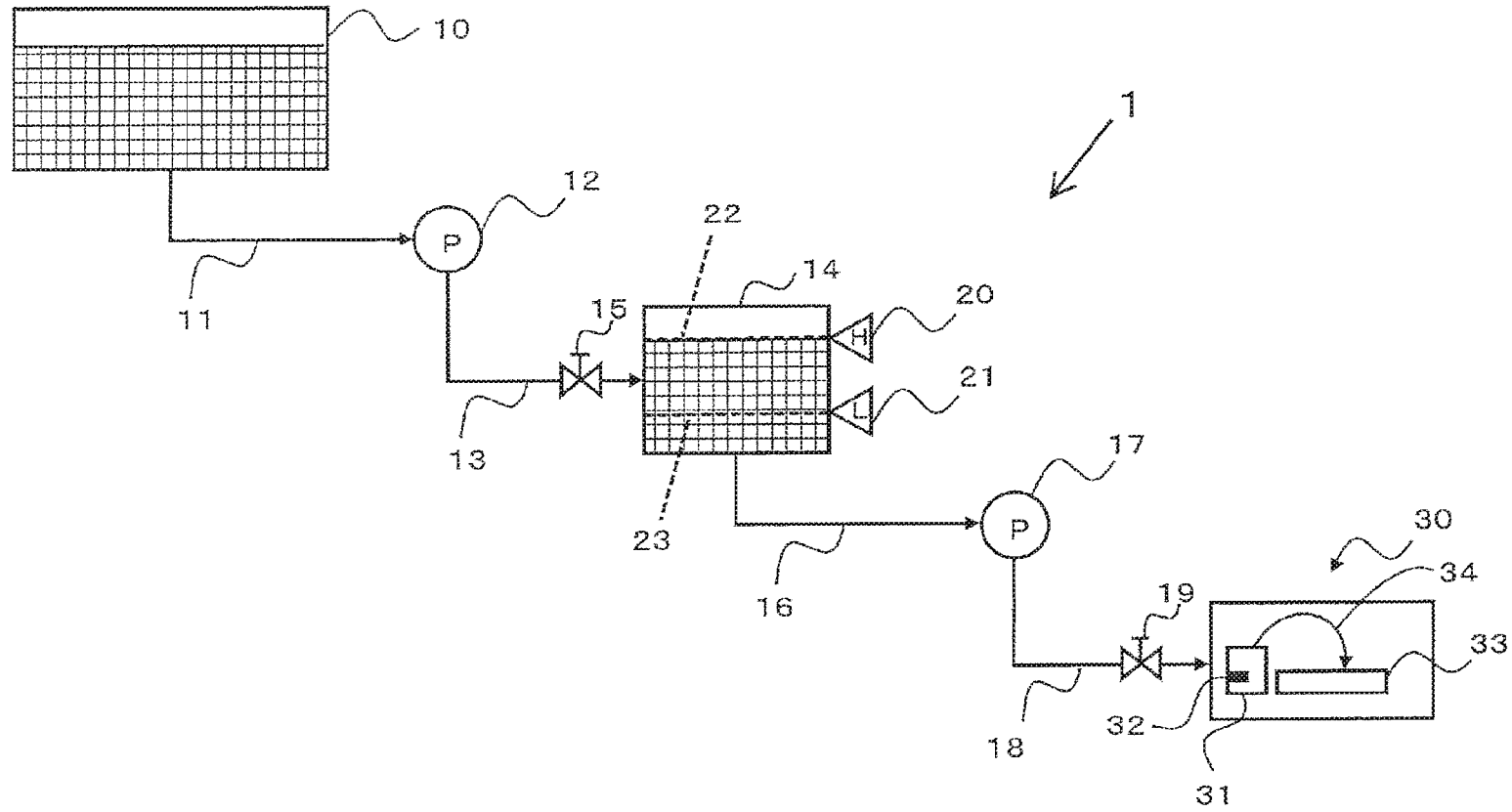
FIG. 4 is a schematic diagram showing the construction of an ink supply section 1 by way of example, showing a first state of the ink supply section 1.

FIG. 4 is a schematic diagram showing the construction of the ink supply section 1 in the printing apparatus 100 by way of example. Duplicate description for the components shown in FIG. 1 will be omitted. The buffer tank 14 is provided with the first liquid surface sensor 20 and the second liquid surface sensor 21. A first liquid surface level 22 and a second liquid surface level 23 lower than the first liquid surface level 22 are defined in the buffer tank 14. The first liquid surface sensor 20 detects a liquid surface at the first liquid surface level 22, and the second liquid surface sensor 21 detects a liquid surface at the second liquid surface level 23. A predetermined amount (e.g., 1 liter) of ink is stored in a space of the buffer tank 14 between the first liquid surface level 22 and the second liquid surface level 23. In the following description, the predetermined amount described above is referred to as "measurement liquid amount v2."

The first liquid surface sensor 20 is turned on when the ink surface level equals to the first liquid surface level 22, and is turned off when the ink surface level is lowered to less than the first liquid surface level 22. A signal 210 outputted from the first liquid surface sensor 20 is sent to the remaining amount detection unit 201 and the valve/pump control unit 203 (see FIG. 2).

The second liquid surface sensor 21 is turned on when the ink surface level equals to the second liquid surface level 23, and is turned off when the ink surface level is elevated to higher than the second liquid surface level 23. A signal 211 outputted from the second liquid surface sensor is sent to the remaining amount detection unit 201 and the valve/pump control unit 203 (see FIG. 2).

The printer section 30 includes a sub-tank 31, a sub-tank sensor 32, an inkjet head 33, and a connection tube 34. The sub-tank 31 temporarily stores ink supplied to the printer section 30 through the fourth pipe 18. The sub-tank 31 has a very small volume, e.g., about 200 ml. The sub-tank 31 supplies the ink to the inkjet head 33 by a water head difference method.

Also referring to FIG. 2, the sub-tank sensor 32 detects the ink storage state of the sub-tank 31, and applies a signal 212 indicating the ink storage state to the valve/pump control unit 203. When the valve/pump control unit 203 detects that the amount of the ink in the sub-tank 31 is reduced to a predetermined lower limit, the valve/pump control unit 203 actuates the second pump 17 by turning on a signal 213 to be applied to the second pump 17. Ink is supplied from the buffer tank 14 to the sub-tank 31 and, when the valve/pump control unit 203 detects that the amount of the ink in the sub-tank 31 is increased to a predetermined upper limit, the valve/pump control unit 203 turns off the signal 213 to be applied to the second pump 17. Thus, the valve/pump control unit 203 controls the second pump 17, as required, based on the signal 212 applied from the sub-tank sensor 32 so as to constantly store a predetermined amount of ink in the sub-tank 31.

Figure 8:
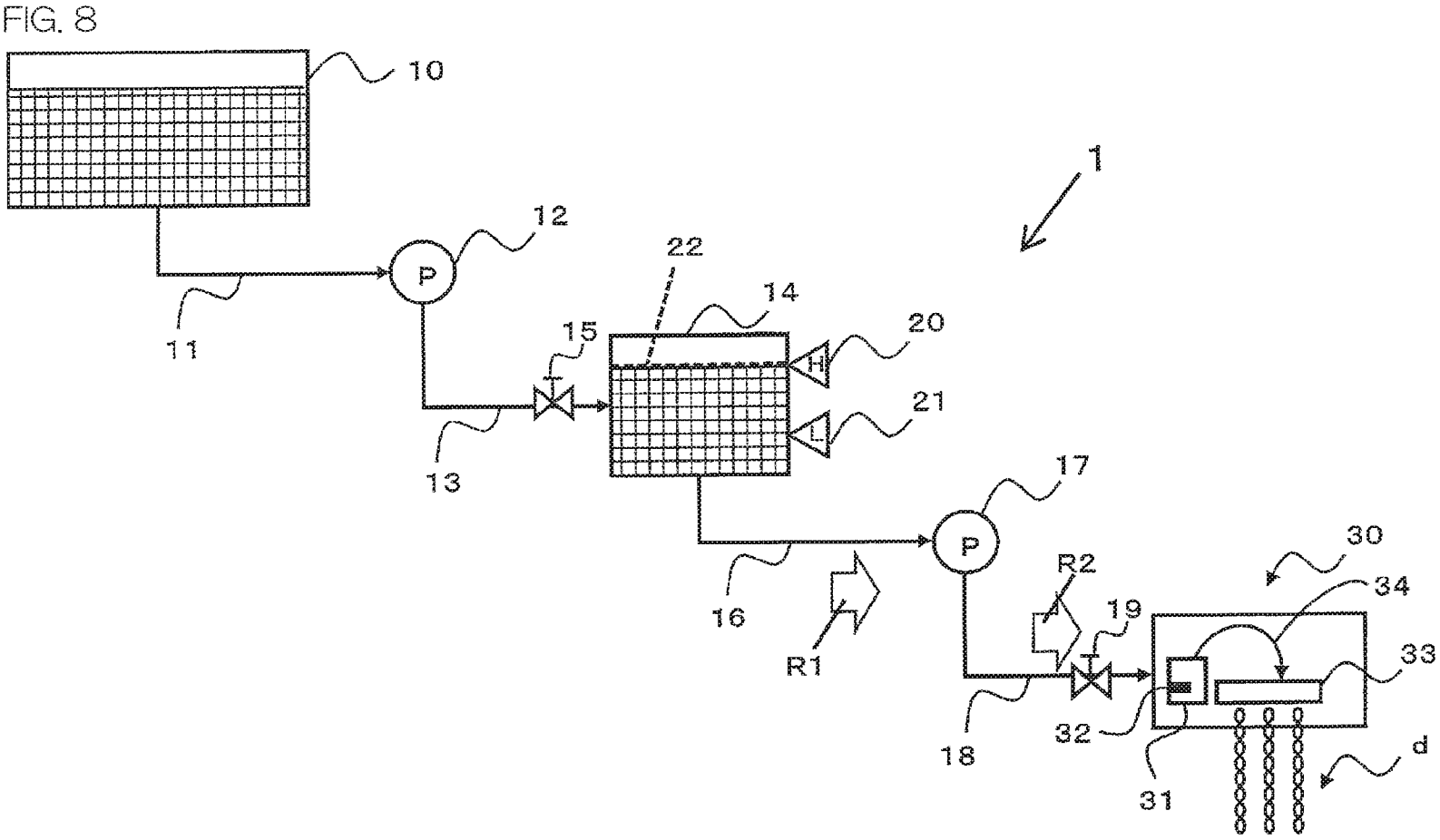
FIG. 8 is a schematic diagram showing the construction of the ink supply section 1 by way of example, showing a fifth state of the ink supply section 1.
Figure 9:
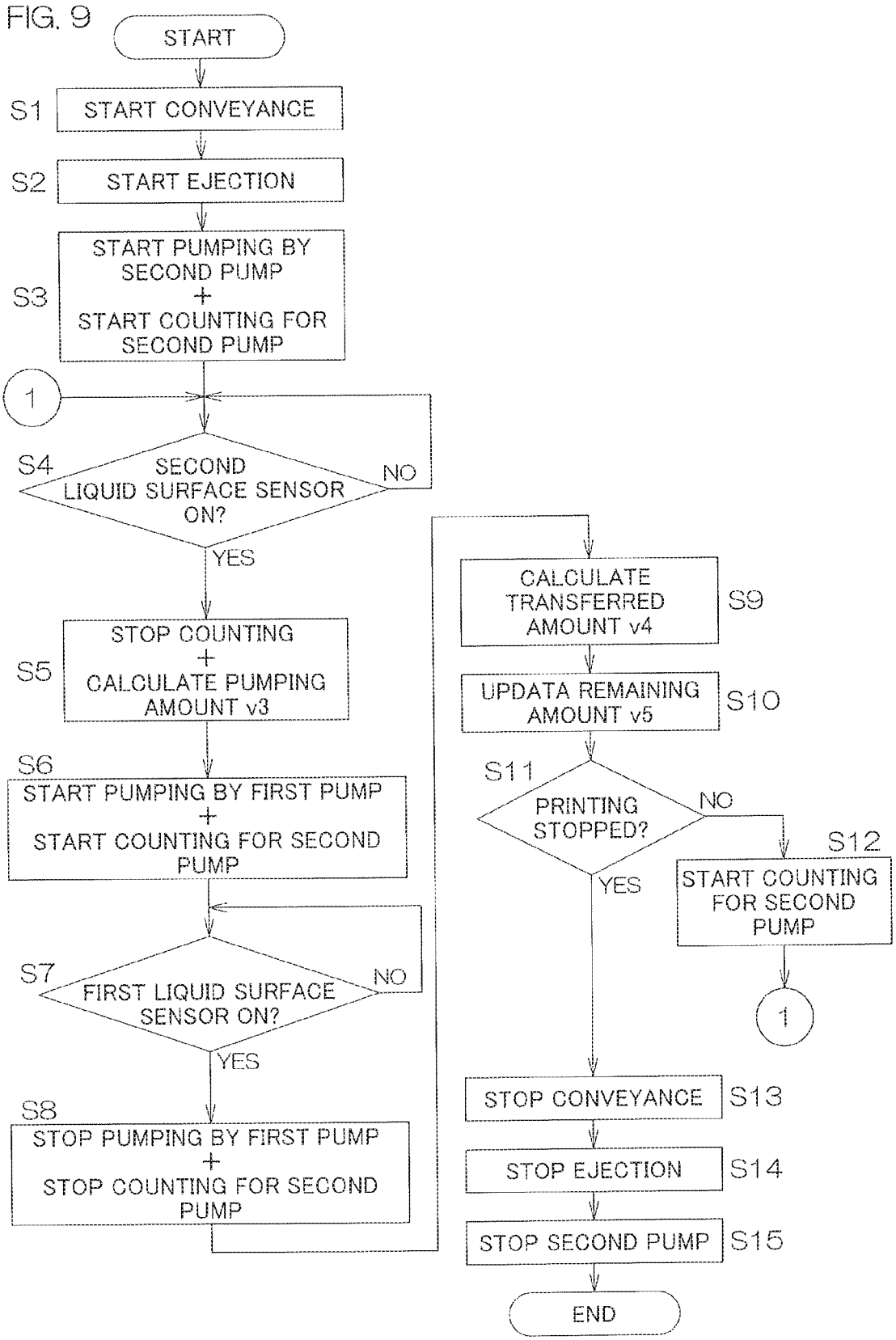
FIG. 9 is a flowchart for describing a remaining ink amount detection operation to be performed in the inkjet printing apparatus.

Next, an example of the remaining amount detection flow sequence for the detection of the remaining ink amount of the main tank 10 in this embodiment will be described with reference to FIGS. 2 to 9. FIGS. 4 to 8 show the change (transition) in the states of the components of the ink supply section 1 and the printer section 30 during the printing operation. FIG. 9 is a flowchart for describing a remaining ink amount detection operation for the detection of the remaining ink amount of the main tank 10 in the inkjet printing apparatus 100.

The initial state of the ink supply section 1 will be described with reference to FIG. 4. In the initial state, the main tank 10 stores the initial ink amount v1 of ink. The first pump 12 and the second pump 17 are not operated. The ink liquid surface level of the buffer tank 14 is equal to the first liquid surface level 22. The first pipe 11, the second pipe 13, the third pipe 16, and the fourth pipe are each filled with ink. The first valve 15 and the second valve 19 are closed. Further, ink droplets d are not ejected from the inkjet head 33. This state is referred to as the initial state or "first state."

Step S1

The control unit 200 starts the printing operation. That is, the conveyance control unit 204 of the control unit 200 drives the drive rollers 40, 44, 50 and 54 to start conveying the continuous paper WP. The valve/pump control unit 203 opens the second valve 19 by means of a signal 214 (see FIG. 2).

Step S2

Figure 5:
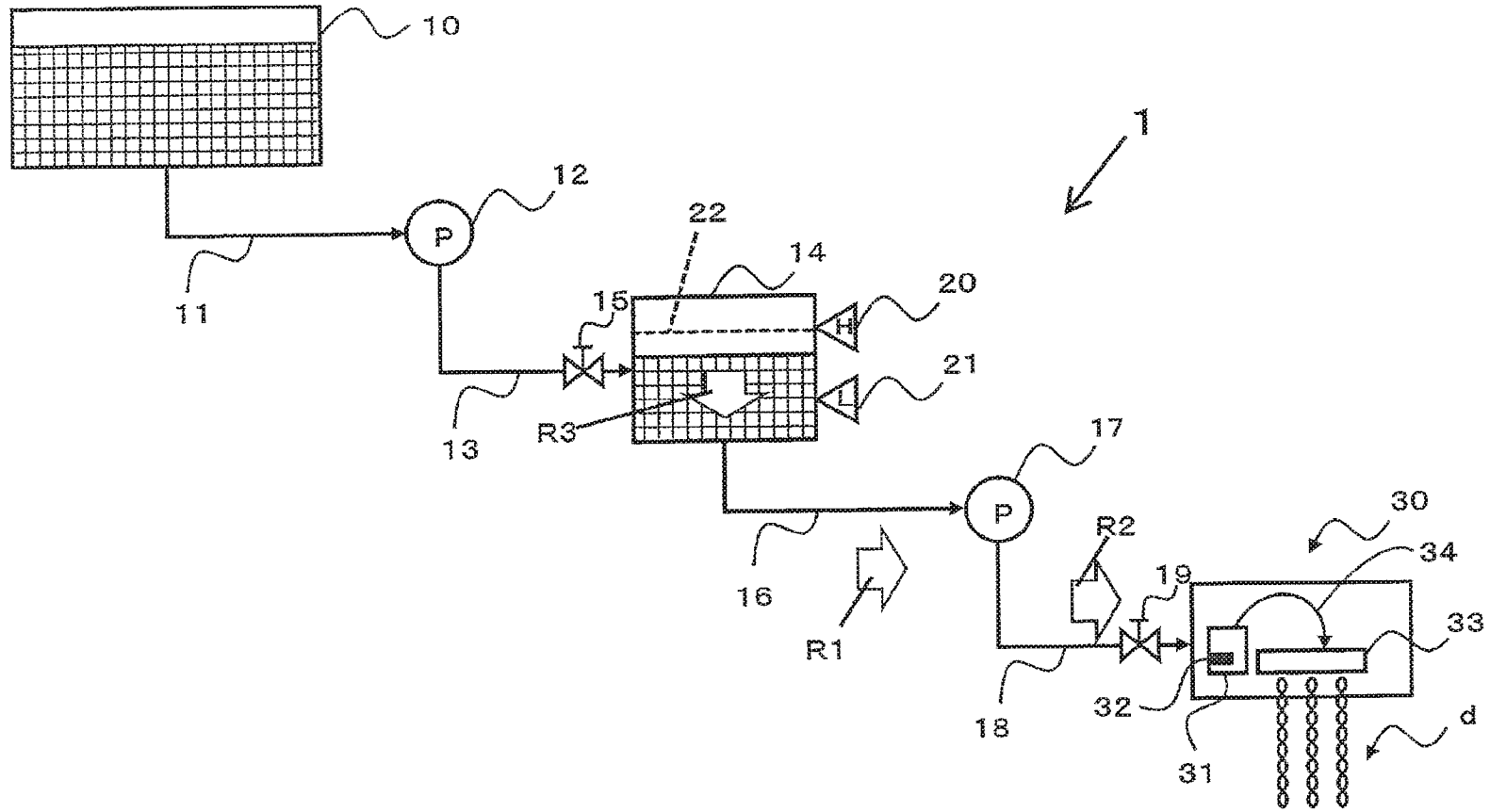
FIG. 5 is a schematic diagram showing the construction of the ink supply section 1 by way of example, showing a second state of the ink supply section 1.

Further, the print control unit 205 supplies image signals to the printer section 30, and starts the droplet ejection from the inkjet head 33. FIG. 5 shows the state of the ink supply section 1 at this stage. That is, the sub-tank 31 supplies ink to the inkjet head 33, as required, according to the ejection amount of the ink droplets d.

Step S3

The ink in the sub-tank 31 is consumed, as the inkjet head 33 ejects the ink droplets d. As described above, the control unit 200 starts driving the second pump 17 to constantly store the predetermined amount of ink in the sub-tank 31 by turning on the signal 213 based on the signal 212 applied from the sub-tank sensor 32 (also see FIG. 2). Thus, liquid flows occur in the third pipe 16 and the fourth pipe 18 as indicated by arrows R1 and R2, respectively, in FIG. 5. The ink flows out of the buffer tank 14 to the third pipe 16, whereby the liquid surface level of the buffer tank 14 is gradually lowered from the first liquid surface level 22 as indicated by an arrow R3. This state is referred to as "second state." The second pump 17 starts pumping the ink and, at the same time, the count unit 206 (see FIG. 3) of the remaining amount detection unit 201 starts counting the drive time of the second pump 17 with reference to the signal 213 applied to the second pump 17. Since the second pump 17 intermittently pumps the ink, the count unit 206 intermittently counts the drive time of the second pump 17. That is, the count unit 206 counts the drive time of the second pump 17 by advancing the timer 202 only when the second pump 17 is driven.

When the driving of the second pump 17 is stopped, the count unit 206 stops the timer 202. When the driving of the second pump 17 is resumed, the count unit 206 restarts the advancement of the timer 202. In other words, the count unit 206 successively accumulates the drive time of the second pump 17 for update of the drive time whenever the driving of the second pump 17 is stopped. After Step S3, the count unit 206 thus intermittently counts the drive time of the second pump 17.

Step S4

After Step S3, the count unit 206 and the unit liquid pumping amount calculation unit 207 of the remaining amount detection unit 201 and the valve/pump control unit 203 start monitoring the second liquid surface sensor 21, i.e., monitoring whether the second liquid surface sensor 21 is turned on.

Step S5

Figure 6:
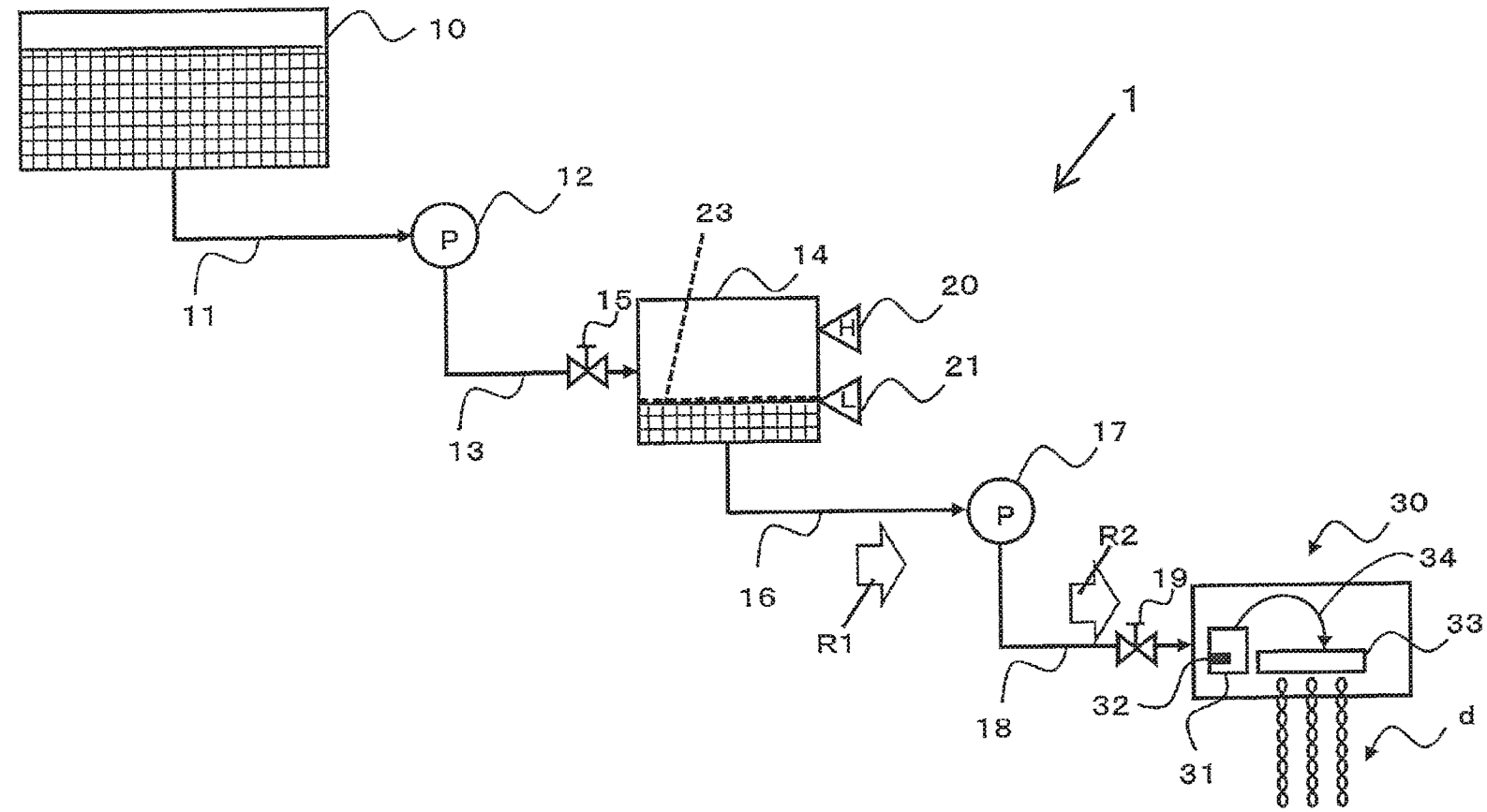
FIG. 6 is a schematic diagram showing the construction of the ink supply section 1 by way of example, showing a third state of the ink supply section 1.
Figure 7:
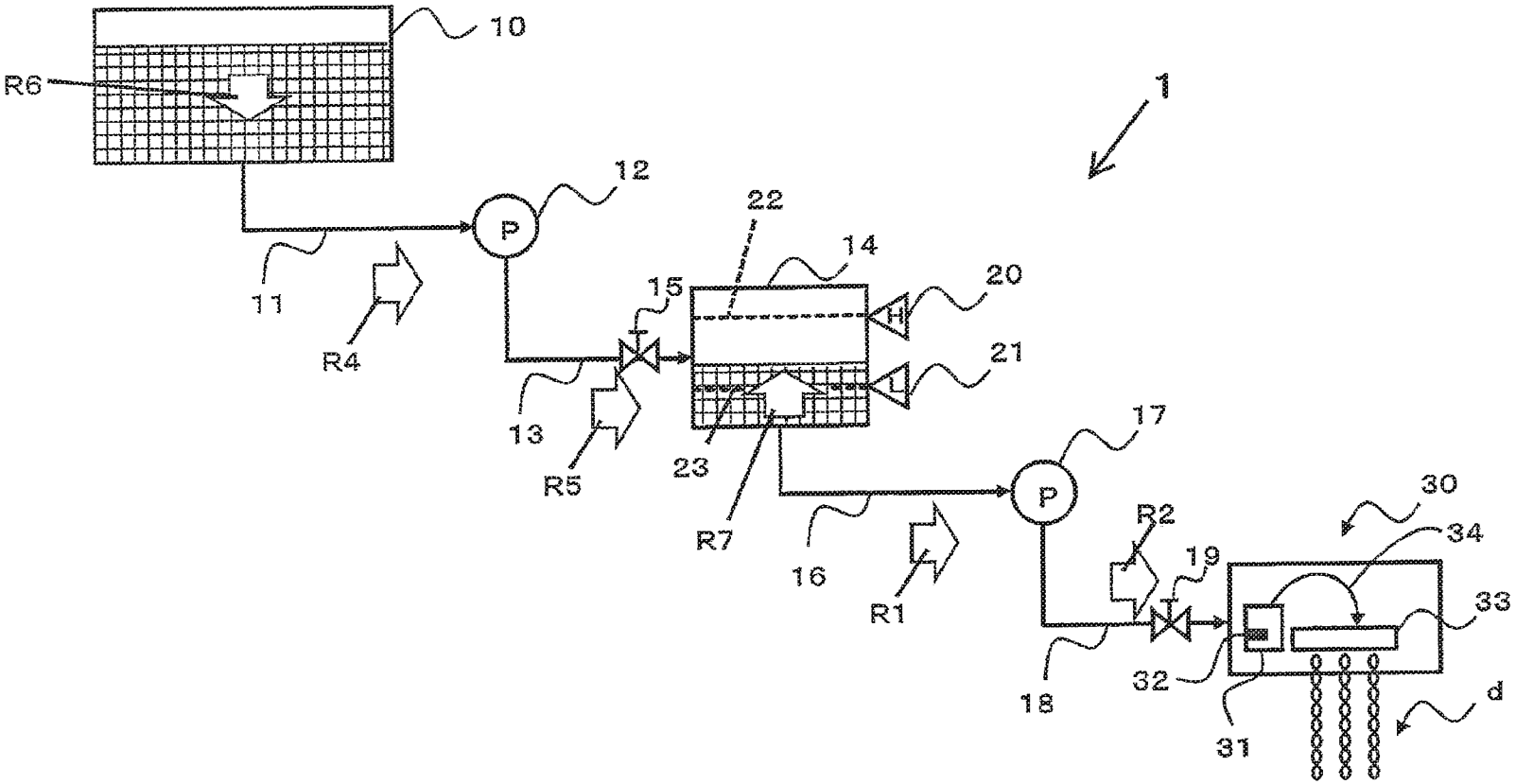
FIG. 7 is a schematic diagram showing the construction of the ink supply section 1 by way of example, showing a fourth state of the ink supply section 1.

When the liquid surface level of the buffer tank 14 is lowered to the second liquid surface level 23 and the second liquid surface sensor 21 is turned on, the determination result in Step S4 is YES. Then, the count unit 206 of the remaining amount detection unit 201 stops the intermittent counting of the drive time of the second pump 17 started in Step S3. At the same time, the unit liquid pumping amount calculation unit 207 of the remaining amount detection unit 201 calculates the unit liquid pumping amount v3 of the second pump 17 based on the following expression (1):

$$v3=v2/t1 \quad (1)$$

wherein t1 is a total drive time of the second pump 17 from Step S3 to Step S5 (hereinafter referred to as "first drive time t1"). Since the second pump 17 supplies the measurement liquid amount v2 of ink from the buffer tank 14 to the printer section 30 during this period, the unit liquid pumping amount v3 per unit time of the second pump 17 can be calculated by dividing the measurement liquid amount v2 by the first drive time t1. The unit liquid pumping amount calculation unit 207 stores the unit liquid pumping amount v3 of the second pump 17 calculated in Step S5 in the memory 300. FIG. 6 shows the state of the ink supply section 1 when the determination result in Step S4 is YES. This state is referred to as "third state." An operation performed in Step S3 to Step S5 is sometimes referred to as "calibration operation." Since the unit liquid pumping amount v3 is calculated based on the expression (1), the output unevenness attributable to the change of the second pump 17 with time and the liquid temperature variation of the ink can be normalized.

Step S6

If the determination result in Step S4 is YES, the valve/pump control unit 203 opens the first valve 15 by means of a signal 215 (see FIG. 2), and starts driving the first pump 12 by means of a signal 216 (see FIG. 2). Thus, the ink is pumped from the main tank 10 to the buffer tank 14 as indicated by arrows R4 and R5 in FIG. 7, whereby the liquid surface level of the main tank 10 is lowered (arrow R6). Further, the liquid surface level of the buffer tank 14 is elevated toward the first liquid surface level 22 (arrow R7). This state is referred to as "fourth state." Since the ink droplets d are continuously ejected from the inkjet head 33 even in the fourth state, the supply of the ink from the buffer tank 14 to the printer section 30 (arrows R1, R2) is continued. In the fourth state, therefore, the buffer tank 14 continuously supplies the ink to the printer section 30 while receiving the ink from the main tank 10.

When the first pump 12 starts pumping the ink, the count unit 206 starts counting the drive time of the second pump 17 from zero.

Step S7

After Step S6, the count unit 206 and the transferred amount calculation unit 208 (see FIG. 3) of the remaining amount detection unit 201 and the valve/pump control unit 203 start monitoring the output of the first liquid surface sensor 20, i.e., monitoring whether the first liquid surface sensor 20 is turned on (Step S7).

Step S8

When the first liquid surface sensor 20 is turned on and the determination result in Step S7 is YES, the valve/pump control unit 203 closes the first valve 15 by means of the signal 215 (see FIG. 2), and stops the pumping of the first pump 12 by means of the signal 216 (see FIG. 2). At the same time, the count unit 206 stops the counting of the drive time of the second pump 17. FIG. 8 shows the state of the ink supply section 1 at this time. This state is referred to as "fifth state." A period from Step S6 to Step S8, i.e., a period during which the ink is supplied from the main tank 10 to the buffer tank 14, is referred to as a measurement period. The liquid surface level of the buffer tank 14 is elevated from the second liquid surface level 23 to the first liquid surface level 22 during the measurement period.

The liquid flow of the ink from the buffer tank 14 to the printer section 30 is continued in the measurement period (arrows R1, R2).

Step S9

Next, the transferred amount calculation unit 208 (see FIG. 3) of the remaining amount detection unit 201 calculates the transferred ink amount v4 during the measurement period (the period from Step S6 to Step S8) based on the following expression (2). The transferred ink amount v4 is the amount of ink transferred from the main tank 10 to the buffer tank 14 during the measurement period.

$$v4=v2+v3\cdot t2 \tag{2}$$

wherein t2 is a total drive time (second drive time t2) of the second pump 17 during the measurement period (the period from Step S6 to Step S8).

In the period from Step S6 to Step S8 (measurement period), as described above, the ink continuously flows from the buffer tank 14 to the printer section 30. Therefore, the transferred ink amount v4 of the ink transferred from the main tank 10 during the measurement period cannot be calculated based only on the measurement liquid amount v2 of the buffer tank 14. That is, the amount of the ink flowing out of the buffer tank 14 in this period (=(unit liquid pumping amount v3 per unit time of second pump 17)× (second drive time t2)) should be added to the measurement liquid amount v2. The expression (2) indicates this procedure. Step S9 corresponds to an example of the transferred ink amount calculation step in the embodiment of the present invention.

Step S10

Next, the remaining amount update unit 209 detects the remaining ink amount v5 of the main tank 10 observed in Step S8 based on the following expression (3):

$$v5=v1-v4 \tag{3}$$

wherein v1 is the initial ink amount of the main tank 10 as described above. Step S10 corresponds to an example of the remaining ink amount detection step in the embodiment of the present invention.

The remaining amount update unit 209 stores the detected remaining ink amount v5 in the memory 300. In the second and subsequent loops, the remaining ink amount v5 stored in the memory 300 in the previous loop is updated with the latest remaining ink amount v5. The remaining amount update unit 209 may report the latest remaining ink amount v5 to the user through the input/output unit 400. When the remaining ink amount v5 is updated, the remaining amount update unit 209 replaces the initial ink amount v1 with the updated remaining ink amount v5 to thereby update the initial ink amount v1. Then, the remaining amount update unit 209 stores the updated initial ink amount v1 in the memory 300.

Step S11

Next, the print control unit 205 determines whether the printing operation is to be stopped. If the printing operation is not stopped, the process goes to Step S12. If the printing operation is stopped, the process goes to Step S13.

Step S12

If the printing operation is not stopped, the process goes to Step S12, and the count unit 206 starts counting the drive time of the second pump 17. Returning from Step S12 to Step S4, the next loop is restarted. In Step S5, however, the method for the calculation of the unit liquid pumping amount v3 may be different between the first loop and the second and subsequent loops.

In Step S5 of the second and subsequent loops, for example, a value obtained by averaging, based on the expression (4), the latest unit liquid pumping amount v3 and the unit liquid pumping amounts v3 calculated in Step S5 of the previous loops may be stored as the unit liquid pumping amount v3 in the memory 300.

$$v3=\{v3(1)+v3(2)+v3(3)\ldots+v3(n)\}/n \tag{4}$$

wherein the parenthesized numbers of the unit liquid pumping amounts v3 ($n$) each indicate a loop number when the unit liquid pumping amount v3 is calculated. By thus averaging the unit liquid pumping amounts v3 based on the expression (4), the output unevenness attributable to the change of the second pump 17 with time and the liquid temperature variation of the ink can be normalized.

For the calculation of the unit liquid pumping amount v3, the average value may be calculated by properly weighting the unit liquid pumping amounts v3, for example, by giving a higher weight to the latest unit liquid pumping amount v3. Alternatively, only the latest unit liquid pumping amount v3 may be used without the averaging.

Step S13

If it is determined in Step S11 that the printing operation is stopped (YES in Step S11), the process goes to Step S13. The conveyance control unit 204 stops the driving of the drive rollers 40, 44, 50 and 54 to stop the conveyance of the continuous paper WP.

Step S14

Next, the print control unit 205 stops the ejection of the ink droplets from the printer section 30.

Step S15

Next, the valve/pump control unit 203 stops the driving of the second pump 17 by turning off the signal 213 (see FIG. 2) regardless of the signal 212 applied from the sub-tank sensor 32.

The printing apparatus 100 performs the printing operation on the continuous paper WP based on a series of image data called "job." When the remaining ink amount of the main tank 10 is reduced to zero during execution of a specific job, however, the printing of the job should be interrupted. According to this embodiment, the remaining amount detection unit 201 can detect the latest remaining ink amount of the main tank 10 within an error range slightly greater than the measurement liquid amount v2 while the printing operation is continuously performed. Therefore, before the start of the printing of a new job, it is possible to determine whether or not to start the execution of the job by acquiring the estimated ink amount necessary for the printing of the job and comparing the acquired estimated ink amount with the remaining ink amount of the main tank 10.

In the embodiment described above, the second pump is the metering pump which supplies the predetermined amount of ink per unit time and, therefore, the unit liquid pumping amount v3 per unit time is calculated in Step S5. Alternatively, the second pump 17 may be a metering pump of pulse signal input type which pumps a predetermined amount of ink per unit pulse. In this case, the remaining amount detection unit 201 (count unit 206) determines the total number of pulses applied to the second pump 17 by the valve/pump control unit 203 in Step S3 to Step S5, and then the unit liquid pumping amount calculation unit 207 calculates a unit liquid pumping amount v3 per unit pulse in Step S5. Similarly, the remaining amount detection unit 201 (count unit 206) determines the total number of pulses applied to the second pump 17 by the valve/pump control unit 203 in the measurement period from Step S6 to Step S8. Then, the transferred amount calculation unit 208 calculates the transferred ink amount v4 based on the total pulse number in Step S9.

As described above, the second pump 17 is the metering pump which supplies the predetermined amount of ink per unit drive amount (e.g., per unit time or per unit pulse). Then, the remaining amount detection unit 201 (more specifically, the count unit 206) determines the operation state of the second pump 17 during the measurement period by determining the total unit drive amount (total time or total pulse number) for which the second pump 17 is operated in the measurement period.

In the embodiment described above, the continuous paper WP is employed as the printing medium, but the present invention is also applicable to a case in which paper sheets are used as the printing medium.

While the embodiments of the present invention have been described in detail, these embodiments are merely specific examples that are illustrative of the technical principles of the present invention but not limitative of the invention. The spirit and scope of the present invention are limited only by the appended claims.

REFERENCE SIGNS LIST

1 Ink supply section
3 Paper feeding section
4 Printing unit
5 Drying unit
6 Paper output section
10 Main tank
11 First pipe
12 First pump
13 Second pipe
14 Buffer tank
15 First valve
16 Third pipe
17 Second pump
18 Fourth pipe
19 Second valve
20 First liquid surface sensor
21 Second liquid surface sensor
22 First liquid surface level
23 Second liquid surface level
30 Printer section
31 Sub-tank
32 Sub-tank sensor
33 Inkjet head
34 Connection tube
40 Drive roller
41 Timing roller
42 Timing roller
43 Timing roller
44 Drive roller
50 Drive roller
51 Timing roller
52 Heat roller
53 Timing roller
54 Drive roller
100 Printing apparatus
200 Control unit
201 Remaining amount detection unit
300 Memory
400 Input/output unit
WP Continuous paper (printing medium)

The invention claimed is:

1. An inkjet printing apparatus comprising:

a first tank which stores ink;

a second tank which stores ink;

a printer section including an inkjet head which ejects ink droplets toward a printing medium;

a first supply system which supplies ink from the first tank to the second tank;

a second supply system which includes an ink supply pump and supplies ink from the second tank to the printer section; and a remaining amount detection unit which calculates an amount of ink transferred from the first tank to the second tank in a measurement period during which ink is supplied from the first tank to the second tank, based on an increase in an amount of the ink stored in the second tank in the measurement period and an operation state of the pump in the measurement period, and detects an amount of ink remaining in the first tank at end of the measurement period by subtracting the transferred ink amount from an amount of ink remaining in the first tank at start of the measurement period.

2. The inkjet printing apparatus according to claim 1, wherein a first liquid surface level and a second liquid surface level lower than the first liquid surface level are defined in the second tank, wherein the second tank includes a first liquid surface sensor which detects an ink liquid surface at the first liquid surface level, and a second liquid surface sensor which detects the ink liquid surface at the second liquid surface level, and wherein the remaining amount detection unit defines the measurement period as a period between start of elevation of the ink liquid surface from the second liquid surface level and the detection of the ink liquid surface at the first liquid surface level by the first liquid surface sensor.

3. The inkjet printing apparatus according to claim 2,
wherein the pump is a metering pump which supplies a predetermined amount of ink per unit drive amount, and
wherein the remaining amount detection unit determines the operation state of the pump by determining a total unit drive amount of the pump for which the pump is driven in the measurement period.

4. The inkjet printing apparatus according to claim 3,
wherein a calibration operation is performed to operate the pump until the ink liquid surface is lowered to the second liquid surface level in the second tank in a state such that the ink supply to the second tank by the first supply system is stopped and the ink is stored to the first liquid surface level in the second tank, and
wherein the remaining amount detection unit calculates an ink supply amount per unit drive amount of the pump by dividing a measurement liquid amount by a total unit drive amount of the pump for which the pump is driven during the calibration operation, the measurement liquid amount being defined as an amount of ink stored in a space of the second tank between the first liquid surface level and the second liquid surface level.

5. The inkjet printing apparatus according to claim 3,
wherein the pump is a metering pump which supplies a predetermined amount of ink per unit time, and
wherein the remaining amount detection unit determines the operation state of the pump by determining a total drive time during which the pump is driven in the measurement period.

6. The inkjet printing apparatus according to claim 4,
wherein the pump is a metering pump which supplies a predetermined amount of ink per unit time, and
wherein the remaining amount detection unit determines the operation state of the pump by determining a total drive time during which the pump is driven in the measurement period.

7. The inkjet printing apparatus according to claim 1,
wherein the second tank includes a first liquid surface sensor which detects an ink liquid surface at a first liquid surface level, and a second liquid surface sensor which detects the ink liquid surface at a second liquid surface level which is lower than the first liquid surface level,
wherein the first supply system includes a pump that supplies ink from the first tank to the second tank, and
wherein the pump is controlled based on outputs of the first liquid surface sensor and the second liquid surface sensor.

8. A method for detecting a remaining ink amount in an inkjet printing apparatus including a first tank which stores ink, a second tank which stores ink, a printer section including an inkjet head which ejects ink droplets toward a printing medium, a first supply system which supplies ink from the first tank to the second tank, and a second supply system which includes an ink supply pump and supplies ink from the second tank to the printer section, the method comprising:
a transferred ink amount calculation step of calculating an amount of ink transferred from the first tank to the second tank in a measurement period during which ink is supplied from the first tank to the second tank, based on an increase in an amount of the ink stored in the second tank in the measurement period and an operation state of the pump in the measurement period; and
a remaining amount detection step of detecting an amount of ink remaining in the first tank at end of the measurement period by subtracting the transferred ink amount from an amount of ink remaining in the first tank at start of the measurement period.

* * * * *